United States Patent [19]

Cantrell

[11] Patent Number: 4,761,903

[45] Date of Patent: Aug. 9, 1988

[54] WATERPROOF DISPLAY FRAME

[76] Inventor: Robert L. Cantrell, 114 Chapel Hill Dr., Fairfield, Ohio 45014

[21] Appl. No.: 938,584

[22] Filed: Dec. 5, 1986

[51] Int. Cl.[4] ..... A47C 1/06; G09F 1/10

[52] U.S. Cl. ..... 40/159; 40/152; 40/158.1

[58] Field of Search ..... 40/159, 158 R, 157, 40/156, 152, 152.1, 594, 615, 154

[56] References Cited

U.S. PATENT DOCUMENTS

| | | | |
|---|---|---|---|
| 54,208 | 4/1866 | Rice | 40/152 |
| 158,301 | 12/1874 | Neff | 40/10 R |
| 240,751 | 4/1881 | Newell | 40/152 |
| 764,273 | 7/1904 | Denton | 40/10 R |
| 1,832,704 | 11/1931 | Hausner | 40/156 |
| 2,039,998 | 5/1936 | Hollister | 40/615 |
| 2,242,148 | 5/1941 | Sanders | 40/156 |
| 2,268,529 | 12/1941 | Stiles | 40/156 |
| 2,271,946 | 2/1942 | Miller | 40/158 |
| 2,312,007 | 2/1943 | Thrasher | 40/154 |
| 2,349,340 | 5/1944 | Conway, Jr. | 40/124.1 |
| 2,458,349 | 1/1949 | Cross | 40/154 |
| 2,807,110 | 9/1957 | Buedingen | 40/156 |
| 3,357,121 | 12/1967 | Dorman | 40/158 |
| 3,394,479 | 7/1968 | Siegler | 40/154 |
| 3,442,041 | 5/1969 | Morgan | 40/158 |
| 3,505,140 | 4/1970 | Dunn | 40/158 |
| 3,552,052 | 1/1971 | Allen | 40/154 |
| 3,713,238 | 1/1973 | Hyman et al. | 40/152 |
| 3,857,192 | 12/1974 | Mascolo | 40/158 R |
| 3,956,838 | 5/1976 | Gerrish | 40/154 |
| 4,064,645 | 12/1977 | Wood | 40/159 |
| 4,079,881 | 3/1978 | Sabb | 40/158 R |
| 4,231,833 | 11/1980 | Lieberman | 40/152 |
| 4,332,095 | 6/1982 | Tanney | 40/158 R |
| 4,424,637 | 1/1984 | Leahy | 40/158 R |
| 4,584,218 | 4/1986 | Travis | 40/594 |

FOREIGN PATENT DOCUMENTS

| | | | |
|---|---|---|---|
| 3340598 | 5/1985 | Fed. Rep. of Germany | 40/156 |
| 556595 | 2/1924 | France | 40/156 |
| 2415988 | 10/1979 | France | 40/594 |
| 242845 | 11/1925 | United Kingdom | 40/156 |
| 2136623 | 9/1984 | United Kingdom | 40/152 |

*Primary Examiner*—Robert Peshock
*Assistant Examiner*—J. Hakomaki
*Attorney, Agent, or Firm*—Wood, Herron & Evans

[57] ABSTRACT

Pictures are displayed by means of a frame comprised of a light-transmissive rigid plate and a flexible water-impermeable sealing sheet. The picture is placed on the rear face of the rigid plate. The picture is then sealed onto the rigid plate by a flexible water-impermeable sheet having an adhesive coating on the face of the sheet which contacts the picture. The picture is viewed through the front face of the rigid plate.

3 Claims, 1 Drawing Sheet

WATERPROOF DISPLAY FRAME

This invention relates to a frame for displaying pictures and more particularly to a frame which aesthetically displays a picture and imparts waterproofing protection to the displayed picture.

BACKGROUND OF THE INVENTION

Means for displaying pictures are well known in the art. A readily recognized example of such display means is the wood bordered frame having a thin glass front pane, a paper picture border and a paper backing sheet. The disadvantages of this type of display frame are that first the frame is fragile, and second that the displayed picture is not protected from moisture and is sometimes exposed to airborne contaminants.

Alternative means have been devised which protect the picture better than the wooden frame. Examples of such alternative means are found in previously issued patents. In U.S. Pat. No. 3,442,041, a photograph is permanently mounted by inserting a photograph between two halves of a transparent plastic sheet coated with pressure-sensitive adhesive and folded in the middle. The photograph becomes adhesively sealed at both its front and reverse faces to the plastic, the folded plastic being larger in both dimensions than the photograph. However, the sealed photograph is not suitable for hanging, and the manner of sealing leaves the photograph irreversibly bound between the plastic halves. U.S. Pat. No. 3,505,140 describes a unit for protecting card-like articles wherein the article is placed between two transparent plastic sheets coated with adhesive and joined by a hinge. However, the article after being fixed between the plastic sheets again becomes irreversibly bound. Also, the sealed article is not in a condition suitable for hanging. U.S. Pat. No. 4,231,833 describes a laminated frame assembly wherein the front face of an indicia-bearing sheet is bonded to an adhesive-coated face of a flexible plastic sheet. The plastic sheet contains a framing means to outline a border around the sheet being displayed. The sheet being displaying may be protected by utilization of a polymeric substrate. However, the displayed sheet must need appear through a flexible plastic face, and the displayed sheet is irreversibly bonded to the flexible plastic.

The invention as hereinafter described has as an object the ability to display photographs, drawings, documents and the like behind an aesthetically pleasing, light-transmissive rigid plate in a manner which protects the displayed object from contact with water. This feature permits display of photographs, drawings, documents and the like in places not normally considered amenable for displaying purposes.

It is a further object of this invention to provide a waterproof display means which permits removal of the displayed object from the display means without causing damage to the displayed object.

It is yet a further object of this invention to provide a waterproof aesthetic display means at a reasonable cost.

These and other objects and advantages of this invention will become more readily apparent upon review of the following descriptions and diagrams.

SUMMARY OF THE INVENTION

The invention comprises in part a light-transmissive rigid plate having front and rear faces, peripheral edges and a center. To the rear face of the rigid plate is applied an opaque border which terminates adjacent to the peripheral edges of the rear face. The border at its inside dimension outlines a centered light-transmissive area on the rear face of the rigid plate upon which the face of a picture is laid. The opaque border may be continuous, or it may have an interrupted appearance wherein clear spaces are interspersed among the opaque portions of the border. The term "picture" is meant to include not only photographs, drawings, and paintings, but also newspaper clippings, diplomas, commendations, documents, artwork, needlework and all other articles of a substantially two-dimensional nature capable of being displayed by the invention.

The picture as described above is laid face down onto the rear face of the rigid plate containing the opaque border. The dimensions of the picture may be smaller than the inside dimensions of the opaque border, but it is desired that the picture have at least the same dimensions as those of the inside portion of the opaque border and preferably that the picture's dimensions slightly exceed those of the inside portion of the opaque border. The picture's dimensions in any direction should not exceed those of the outside portion of the opaque border.

After the picture is centered over the light-transmissive area defined by the opaque border, the picture is sealed onto the rigid plate by means of a water-impermeable sheet which is coated on one face with adhesive. The adhesive may cover substantially all of one face of the water-impermeable sheet, or it may cover only a continuous border around the perimeter of the face. The adhesive may be of a permanent type which discourages peel-back and reuse, or it may be of a removable type which would permit the non-destructive removal of the picture and replacement with another.

The dimensions of the water-impermeable sheet should be greater along both directions than those of the picture, and also lesser along both directions than those of the outside portion of the opaque border. Such dimensional values will permit the water-impermeable sheet to seal the picture to the rigid plate without being visible when viewed through the front face of the rigid plate.

A picture thus sealed onto the rigid plate as contemplated by this invention is aesthetically and economically prepared for display. In addition, the picture is protectively sealed, yet the sealing procedure may be reversed to permit non-destructive removal of the picture.

These and other advantages will become readily apparent from the following detailed description of preferred and alternative embodiments of the invention and from the drawings in which:

DETAILED DESCRIPTION OF THE INVENTION

Figure 1:
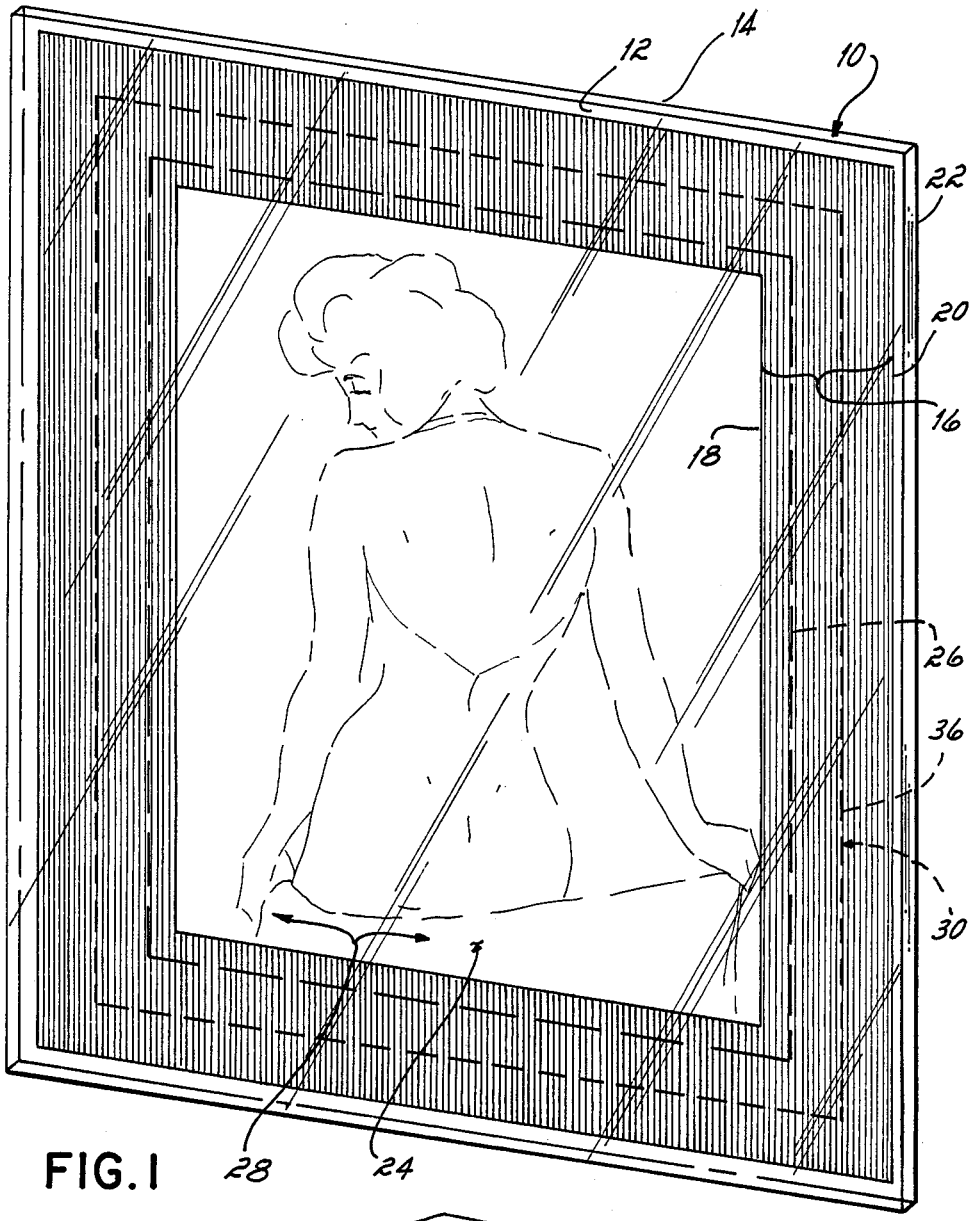
FIG. 1 is a view of the display frame containing a sealed picture as viewed through the front face of the rigid plate.

FIG. 1 presents the display frame as it would be viewed in normal use. Rigid plate 10 contains a front face 12 and a rear face 14, which can be more easily understood by viewing FIG. 2.

Figure 2:
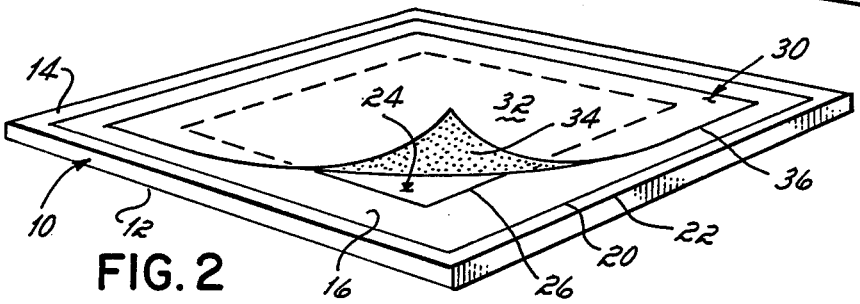
FIG. 2 is a view of the display frame containing a picture which is in the process of being sealed as viewed from behind the rear face of the rigid plate.

An opaque border 16 is circumscribed by an inside boundary line 18 and an outside boundary line 20. Opaque border 16 as shown in FIGS. 1 and 2 is continuous, but said border instead may have an interrupted appearance in an alternative embodiment. In a preferred embodiment of the invention, the opaque border is applied by a screen printing process and does not extend out to the rear face edge 22. However, other border application processes may be used which would extend the border to a point adjacent to the rear face edge 22. Also if desired, a mirrored finish could be applied.

The picture to be displayed is shown in FIG. 1 as 24. The dimensions of picture 24 are depicted by picture boundary line 26. As FIG. 1 shows, the picture boundary line 26 in the preferred embodiment is greater in dimension than the opaque border inside boundary line 18. However, the picture boundary line may have the same dimensions as the opaque border inside boundary line 18, or the picture boundary line dimensions may even be smaller than the opaque border inside boundary line 18. Also, the opaque border 16 does not have a standardized width. The width of the opaque border 16 may be modified to accommodate pictures of lesser or greater dimensions than those of picture 24. In addition, variously dimensioned rigid plates may be used. The plates can be made of a variety of materials such as Lexan® polycarbonate resin, Plexiglas® acrylic resin, among others as well as various grades and thicknesses of glass. In a preferred embodiment, the rigid plate 10 is $11\frac{3}{4}''$ wide and $13\frac{3}{4}''$ high. The centered light-transmissive area 28 bounded by the opaque border inside boundary line 18 is approximately $7\frac{1}{2}''$ wide and $9\frac{1}{2}''$ high, the frame therefore easily accommodating an $8''\times10''$ picture. The distance between the opaque border outside boundary line 20 and the rear face edge 22 is approximately $\frac{1}{4}''$ around the entire perimeter of the rigid plate 10.

As noted, the centered light-transmissive area 28 bounded by the inside boundary line 18 can accommodate an $8''\times10''$ picture. It can also be seen, however, that a $7\frac{1}{2}''\times9\frac{1}{2}''$ picture would be similarly displayable. In addition, a picture having dimensions larger than $8''\times10''$ could be similarly displayed as long as the peripheral edges of the picture mated with the rear face 14 along the opaque border 16. Also, through not a preferred embodiment, the picture being displayed can have dimensions smaller than those of the centered light-transmissive area 28.

The picture 24 after placement and centering is then sealed onto the rear face 14 of the rigid plate 10 by means of a water-impermeable sheet 30 as shown in FIG. 2. The impermeable sheet 30 has a non-adhesive face 32 and an adhesively coated face 34. The adhesively coated face 34 may have adhesive covering substantially all of the surface area of the face, or it may have adhesive only along the peripheral border of the face. The adhesive may be of a permanent type; that is, the water-impermeable sheet 30 containing the adhesive may be intended to be sealed onto the rear face 14 of the rigid plate 10 without any subsequent removal. For example, the FasCal® Brand 960 Clear Acrylic sheet from the Fasson Division of the Avery International Company may be used. The FasCal® 960 sheet employs a permanent acrylic adhesive. The adhesive may also be of a removable type; that is, the water-impermeable sheet 30 containing the adhesive may be intended to be removable from both the rear face 14 of the rigid plate 10 and the picture 24 without causing damage to either the rigid plate 10 or the picture 24. For example, the FasCal® 1700 Easy Off Clear Polyester sheet containing removable adhesive may be used.

The water-impermeable sheet 30 is designated thereby for its ability to prevent water in the liquid form from passing through the sheet. However, certain types of water-impermeable sheet have the ability to additionally prevent the passage of gases and vapors such as water vapor, oxygen, carbon dioxide, nitrogen and the like. Water-impermeable sheets 30 which prevent passage of gases and vapors in addition to liquid water are also intended to be encompassed by this invention. For example, sheets produced from certain grades of high density polyethylene and polytetrafluoroethylene film have these properties.

In a preferred embodiment, the water-impermeable sheet 30 has a boundary 36 as shown in FIG. 1 which falls along the opaque border 16 and is of sufficient dimension to completely seal over the picture boundary line 26. In this embodiment, the water-impermeable sheet 30 is not visible from the viewing side, i.e., through the front face 12 of the rigid plate 10. Therefore, the color of the water-impermeable sheet 30 will not affect its utility. However, in a less preferred embodiment where the picture 24 does not occupy the entire centered light-transmissive area 28, the color of the water-impermeable sheet 30 must be taken into account when displaying the picture 24.

The water-impermeable sheet 30 may be supplied separate from the rigid plate 10 wherein the entire adhesively coated face 34 is covered with a release sheet (not shown). The water-impermeable sheet 30 may also be supplied such that the adhesively coated face 34 of the sheet 30 is sealed onto the rear face 14 of the rigid plate 10. In this mode, the adhesive contained on the face 34 is preferably of the removable type.

The picture 24 sealed onto the rear face 14 of the rigid plate 10 by means of the water-impermeable sheet 30 may be displayed in any number of ways. For example, the rigid plate 10 may be mounted to a vertical surface by means of an adhesive (not shown) applied to the rear face 14 of the rigid plate 10 or the non-adhesive face 32 of the water-impermeable sheet 30. The rigid plate 10 may be hung by means of a hook or ring (not shown) affixed to the rear face 14 of the rigid plate 10. Alternatively, holes (not shown) may be drilled partially or completely through the rigid plate 10 from the rear, and the drilled plate may then be hung from a projection. The rigid plate 10 may be displayed by means of an easel or other tripod-like support means, and may also be placed within a standard wood or metal frame.

The framing assembly comprising the rigid plate 10 and the water-impermeable sheet 30 has a multitude of uses and applications. Because the picture is sealed onto the rigid plate 10, and the rigid plate 10 and water-impermeable sheet 30 are not readily damaged by the elements, a picture protected by this invention can be displayed outdoors, in high-moisture indoor areas such as in bathrooms or kitchens, and even underwater. Where the water-impermeable sheet 30 also prevents passage of gases and vapors, pictures which are susceptible to damage by moisture or harmful gaseous air contaminants can be displayed without fear of damage. To improve the protection of pictures which are sensitive to the air, such as is the case with very old written documents, the sealing process could be accomplished in the presence of an inert gas which would remain in contact with the sealed picture and protect the picture until the seal were later broken.

What is claimed is:

1. A method of displaying a picture in a waterproof frame comprising the steps of:

applying an opaque border to the rear face of a light-transmissive rigid plate having front and rear faces, peripheral edges and a center, said opaque border applied around the perimeter of said rear face, said border spaced from said peripheral edges of said rear face and spaced from the center of said plate whereby a light-transmissive area is defined by said opaque border and a light-transmissive area is provided around the peripheral edges, positioning a picture having marginal edges to be displayed behind the centered light-transmissive area defined by said opaque border on said rear face, the marginal edges of said picture overlying said opaque border, securing said picture to the rear face of said rigid plate by means of a water-impermeable plastic sheet, said sheet having two faces and peripheral edges, an adhesive coating being applied around at least the peripheral edges of said sheet, and said adhesive coated peripheral edges being adhesively secured to said opaque border.

2. The method of claim 1 where the opaque border is applied by a silk screening process.

3. The method of claim 2 wherein the opaque border terminates about one-fourth of an inch from the peripheral edges of the rigid plate.

* * * * *